US005938154A

United States Patent [19]

Bartels

[11] Patent Number: 5,938,154

[45] Date of Patent: Aug. 17, 1999

[54] BALLOON BOUQUET HOLDER

[76] Inventor: Gloria J. Bartels, 113 Glenwood Dr., Brunswick, Ga. 31520-1703

[21] Appl. No.: 09/040,642

[22] Filed: Mar. 18, 1998

[51] Int. Cl.[6] ..... F16M 11/00

[52] U.S. Cl. ..... 248/176.1; 248/346.01; 446/220

[58] Field of Search ..... 248/176.1, 311.2, 248/314, 504, 910, 346.01, 346.03, 346.04, 346.5, 519, 523, 309.1; 446/220; D19/81

[56] References Cited

U.S. PATENT DOCUMENTS

| | | | |
|---|---|---|---|
| D. 371,574 | 7/1996 | Barton et al. | D19/2 |
| 3,559,934 | 2/1971 | Jensen | 248/121 |
| 4,589,854 | 5/1986 | Smith | 446/223 |
| 4,661,081 | 4/1987 | Basseches | 446/220 |
| 4,715,841 | 12/1987 | Nelson et al. | 446/222 |
| 4,798,554 | 1/1989 | Nelson et al. | 446/222 |
| 4,813,902 | 3/1989 | Messer | 446/71 |
| 5,011,447 | 4/1991 | Watanabe | 446/220 |
| 5,016,848 | 5/1991 | Metz | 248/176.1 |
| 5,035,391 | 7/1991 | Steele et al. | 248/346.01 |
| 5,074,510 | 12/1991 | Metz | 248/176.1 |
| 5,188,314 | 2/1993 | Peters | 244/31 |
| 5,240,199 | 8/1993 | Peters | 242/96 |
| 5,509,540 | 4/1996 | Pomerantz | 211/13 |
| 5,755,419 | 5/1998 | Gearhart et al. | 248/346.01 |

*Primary Examiner*—Ramon O. Ramirez
*Assistant Examiner*—Anita M. King
*Attorney, Agent, or Firm*—Chase & Yakimo, L.C.

[57] ABSTRACT

A balloon holding device comprises a dome-like body member attached to a base plate for anchoring a plurality of helium filled balloons for display as a balloon bouquet for festive occasions. A central bore vertically extends through the body member and base plate for receiving tethers from a plurality of balloons. The base plate includes slits suitable for receiving free ends of the balloon tethers. The bottom slits cooperate with vertically disposed slits in the exterior of the body member for frictionally securing free ends of the tethers therein. Balloons can be released from the holder simply by pulling the tethers out of the slits and back through the central bore, thereby making the holder immediately available for reuse.

20 Claims, 7 Drawing Sheets

BALLOON BOUQUET HOLDER

BACKGROUND OF THE INVENTION

This invention relates to a balloon anchor and, more particularly, to a device for releasably tethering a bouquet or cluster of balloons at predetermined heights for display at various festive occasions.

Bouquets of helium filled balloons are often prepared for festive events such as birthdays, anniversaries, retirement parties, and the like. It is known that helium filled balloons must be anchored to an object of sufficient weight to prevent the balloon from escaping into the atmosphere.

Various balloon holders have been disclosed in the prior art which prevent helium balloons from escaping into the atmosphere or onto the ceiling of an enclosed structure. The holders disclosed in U.S. Pat. Nos. 5,035,391 and 5,074,510 to Steele and Metz, respectively, present various appendages to which several helium filled balloons may be attached. Further, U.S. Pat. No. 5,188,314 to Peters discloses a spool member which allows a single balloon tether to be reeled in or out to regulate the height of the balloon.

Although assumably effective in operation, such devices are either complex in construction or provide for inefficient preparation of a bouquet of balloons. Specifically, the '391 and '510 patents require balloons to be individually attached to several anchors, making attachment and detachment difficult and time consuming. Thus, it is desirable to have a balloon holder which requires only one knot to be tied while tethering a plurality of helium balloons in an evenly distributed variable height arrangement.

SUMMARY OF THE INVENTION

In response thereto, I have invented a balloon bouquet holder having a dome-like body member attached to a base plate. A cylindrical bore extends through the center of the body member and base plate for receiving tethers from any number of helium filled balloons, the tethers being singly knotted together once the desired length of each tether has been determined. The bottom side of the base plate includes at least four narrow slits suitable for receiving lower free ends of balloon tethers. The bottom slits cooperate with vertically disposed slits in the exterior side of the body member for receiving and frictionally securing the lower free ends of the balloon tethers. The balloon bouquet is releasable from the holder simply by pulling the tethers back through or out of the slits to allow easy reuse of the balloon holder. The body member may be made of a solid weighted material or, alternatively, can be hollow and transparent for filling with ballast such as hard candy or colored marbles. Thus, the balloon holding device provides a simple, efficient means for preparing and securing decorative balloon bouquet arrangements.

It is therefore a general object of this invention to provide a balloon bouquet holder for releasably anchoring a plurality of tethered helium filled balloons.

Another object of this invention is to provide a balloon bouquet holder, as aforesaid, which anchors tethered balloons at heights predetermined by a user.

Still another object of this invention is to provide a balloon bouquet holder, as aforesaid, which anchors and releases a singly knotted set of balloons.

A further object of this invention is to provide a balloon bouquet holder, as aforesaid, having a plurality of narrow slits for frictionally anchoring a plurality of balloons.

A still further object of this invention is to provide a balloon bouquet holder, as aforesaid, having sufficient weight to anchor a plurality of helium filled balloons.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Turning more particularly to the drawings, FIGS. 1, 3, 4 and 6, show a first embodiment of the balloon bouquet holder 100 having a solid body member 110 preferably made of a heavy material such as lead, ceramic porcelain, clay, wood, or glass. The body member 110 is cylindrical but forms a dome at an upper end thereof. The body member 110 includes a circular base 120 at the lower end thereof, the body member 110 and base 120 having a cylindrical bore 130 centrally extending therethrough for receiving a plurality of balloon tethers singly knotted together, said tethers preferably made of ribbon or string.

Figure 1:
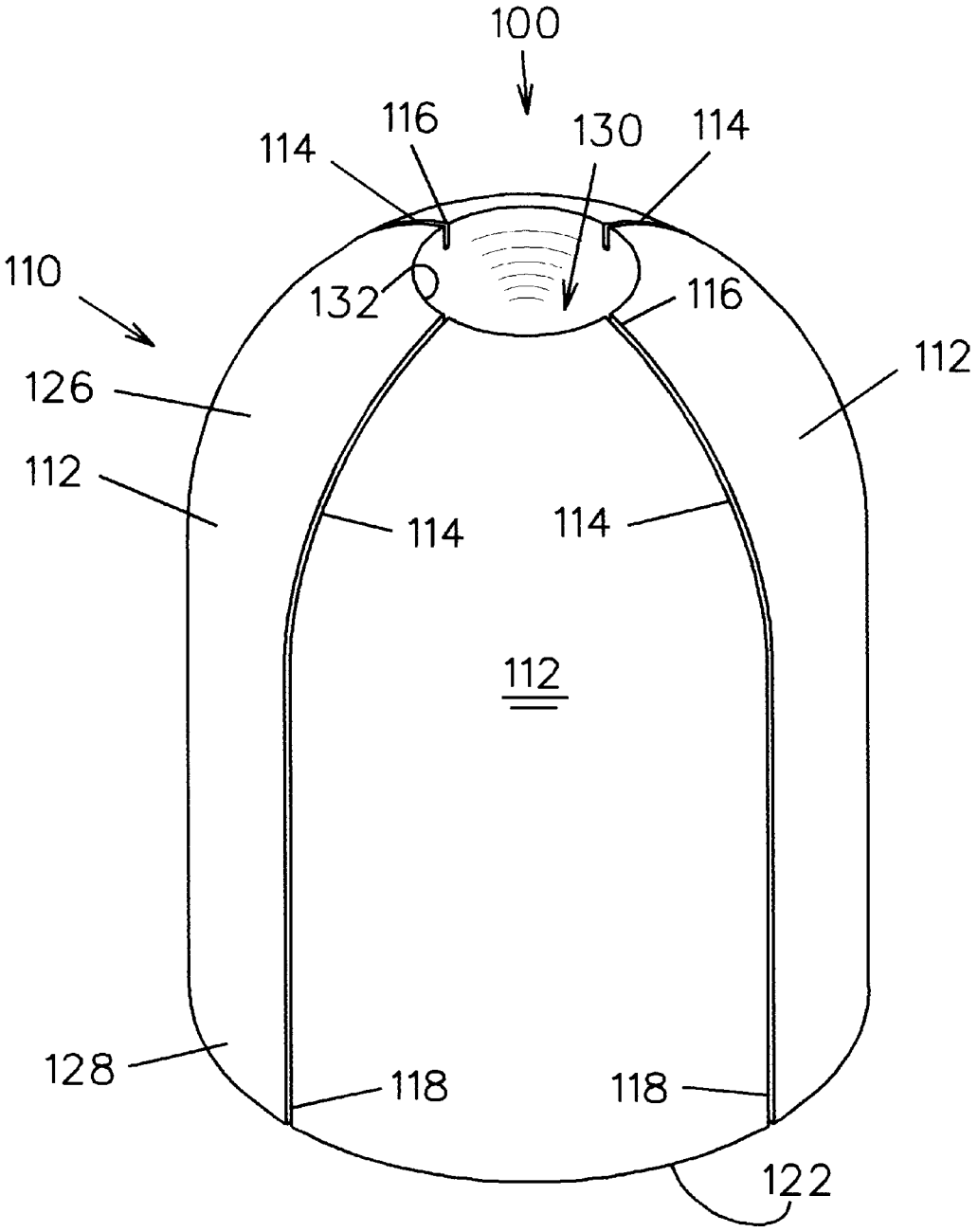
FIG. 1 is a perspective view of a first embodiment of a bouquet holder having a solid body member in accordance with the present invention.
Figure 6:
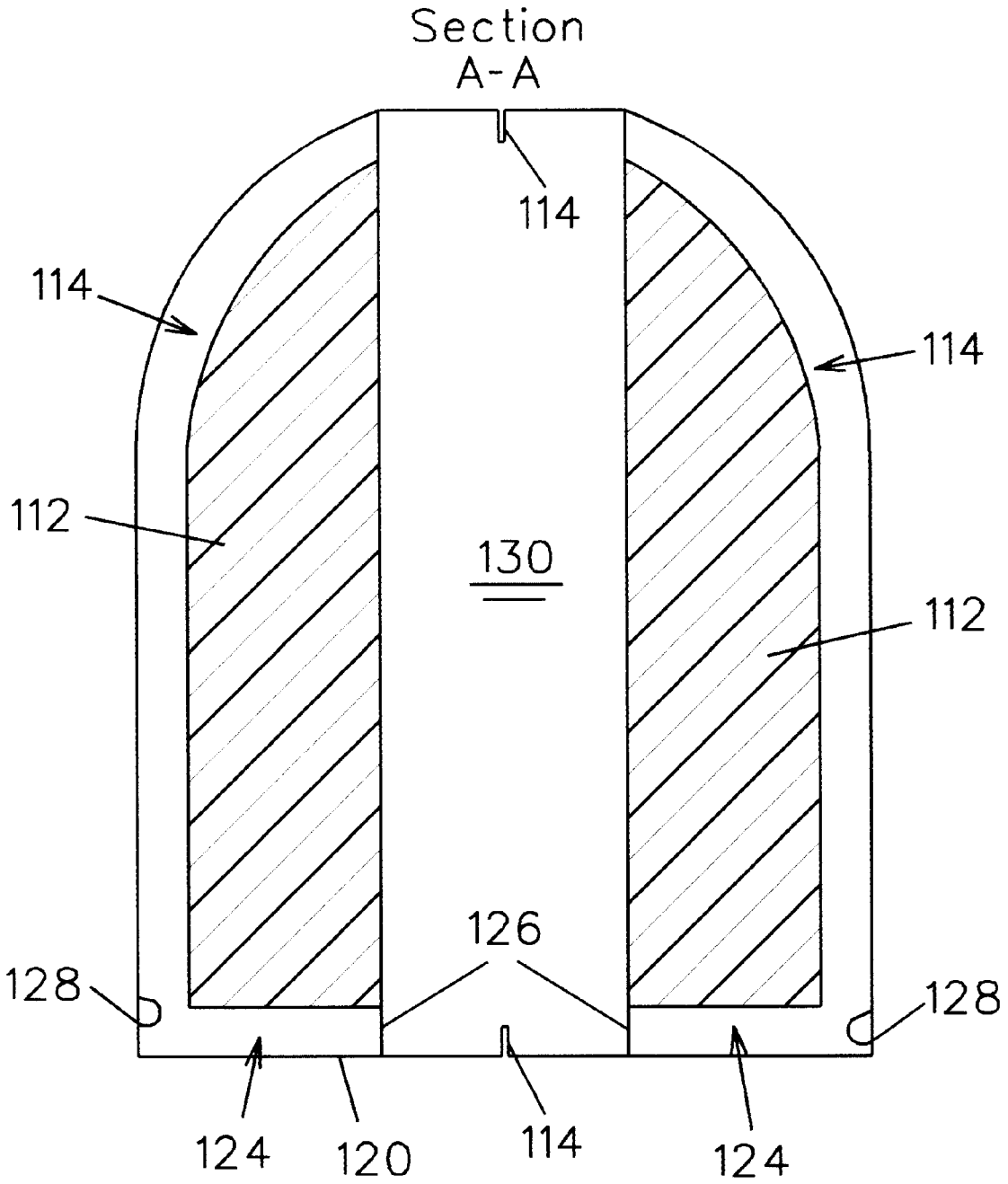
FIG. 6 is a sectional view of the bouquet holder shown in FIG. 3 as taken through plane 6—6.
Figure 7:
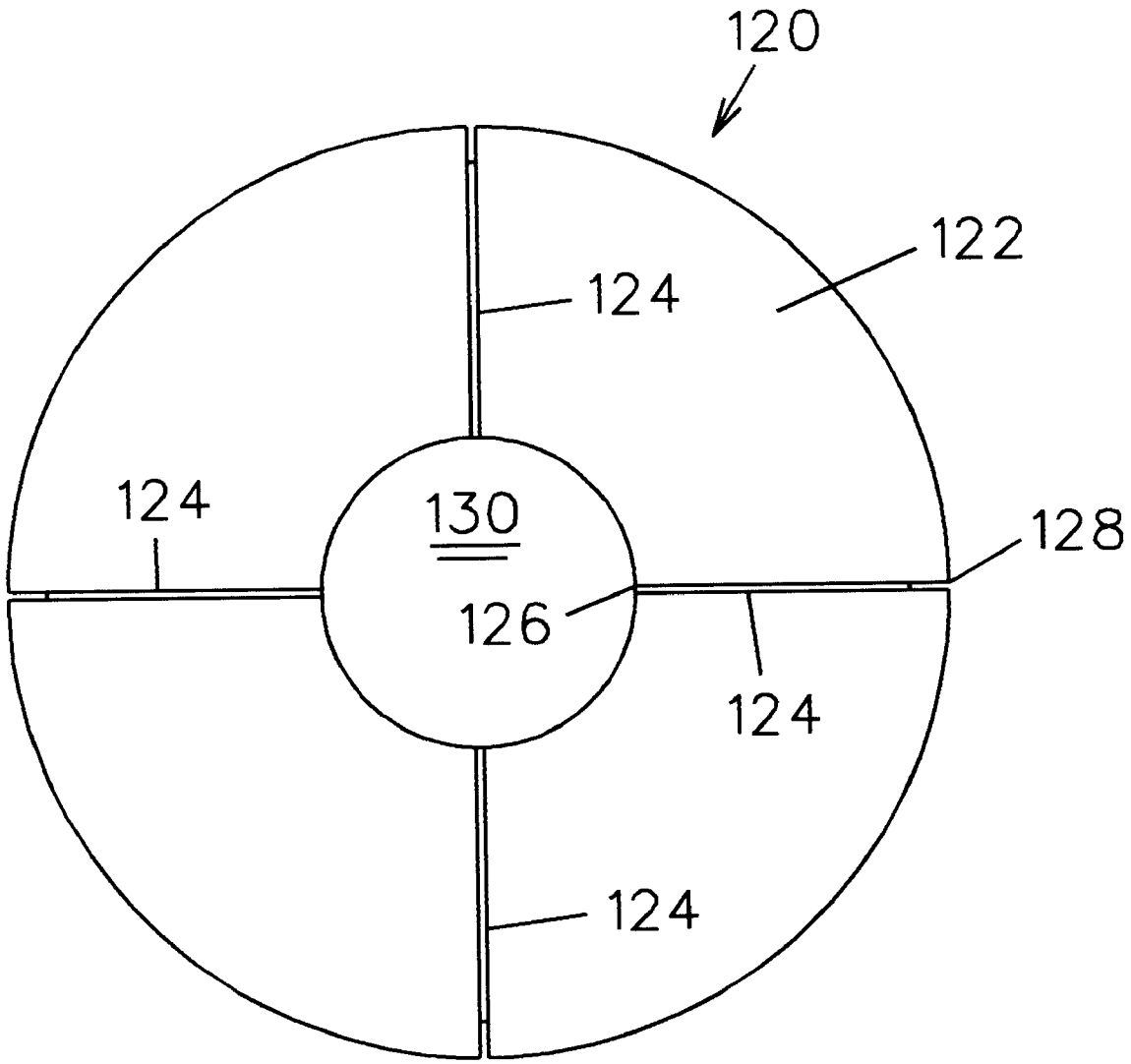
FIG. 7 is a bottom view of the bouquet holder shown in FIG. 1.

The bottom side 122 of the base 120 presents spaced apart horizontally extending slits 124 (FIG. 7), each slit 124 having a first end 126 open to the central bore 130 and extending radially outwardly therefrom to a second opposing end 128 open to the exterior side 112 of the body member 110. The exterior side 112 of the body member 110 includes spaced apart vertically disposed slits 114 extending the entire length of the body member 110 (FIG. 1). Each slit 114 presents an upper end 116 open to the central bore 130 and a lower end 118 in communication with a second end 128 of a corresponding slit 124 in the base plate 120 (FIG. 6). Thus, each pair of corresponding slits 114 and 124 are aligned to present one single continuous slit extending between the bottom and top apertures of bore 130. It is to be understood that while the illustrations show four slits in the base plate and body member, the invention disclosed herein is not constrained to a particular number of slits.

In function, a plurality of tethers 1000 (FIG. 2) of helium filled balloons are positioned at desired lengths and then tied together with a single knot with substantial lengths of the tethers remaining free therebelow. See FIG. 2. The tethers are inserted into an upper aperture 132 of the central bore 130 until the knot approaches the base plate 120. Free ends of the tethers are then inserted first into various slits 124 in the base plate 120 and second into corresponding slits 114 in the body member 110. The tethers are frictionally secured within the narrow slits 114, 124 and are left hanging free at the top of the body member 110 for added decorative effect as shown in the FIG. 2 second embodiment. It is understood that decorative tissue, ribbon, and the like may be wrapped about the balloon bouquet holder 100 for additional decoration thereof or to further secure the tethers within the slits.

Figure 2:
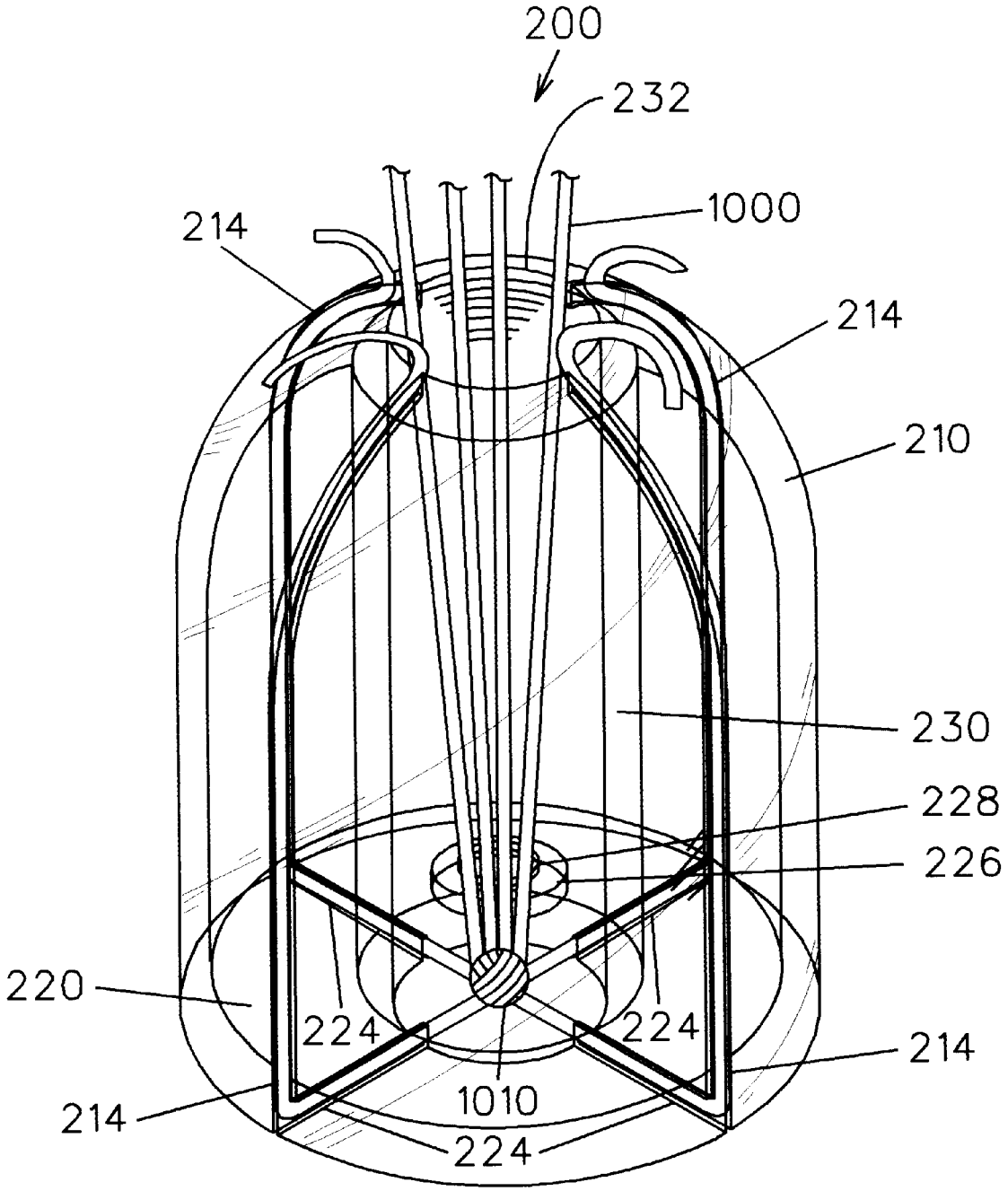
FIG. 2 is a perspective of a second embodiment of a bouquet holder having a transparent, hollow body member showing the lower ends of balloon tethers mounted therein in accordance with the present invention.
Figure 3:
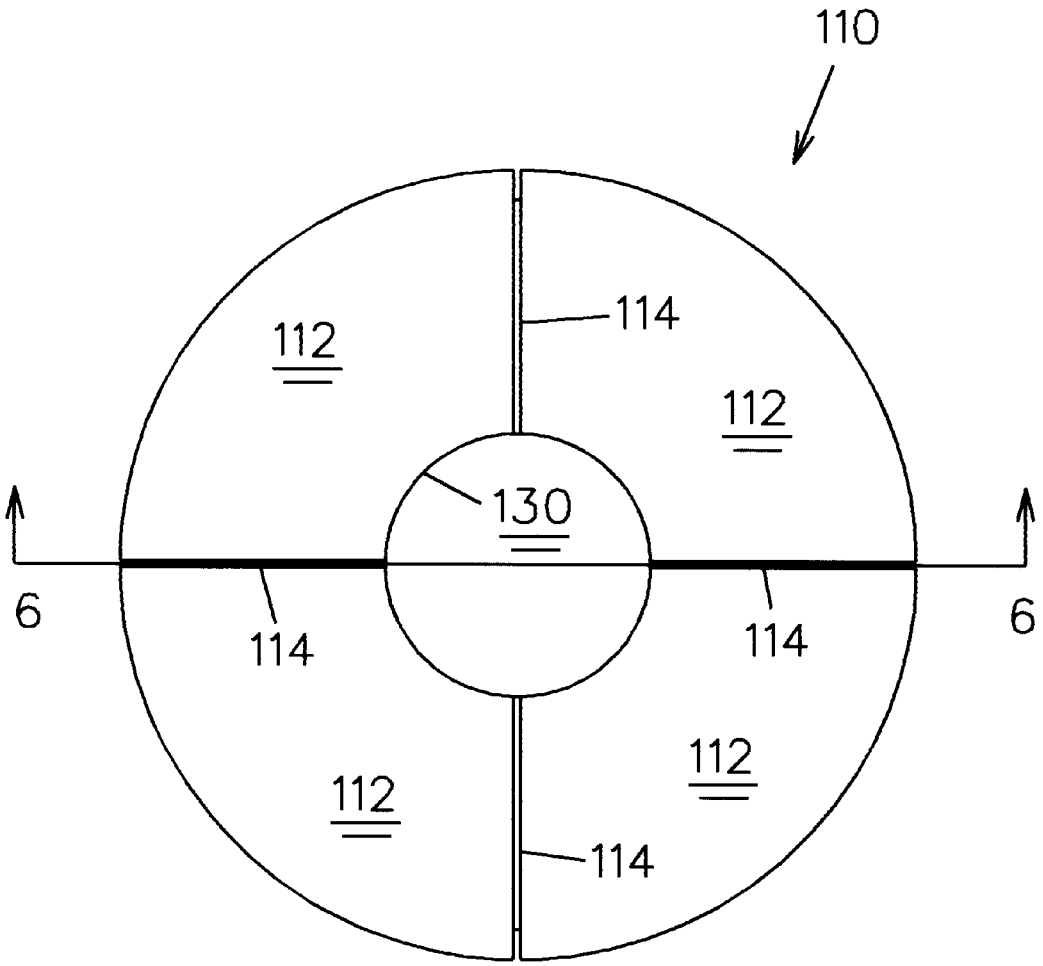
FIG. 3 is a top view of the bouquet holder shown in FIG. 1.
Figure 4:
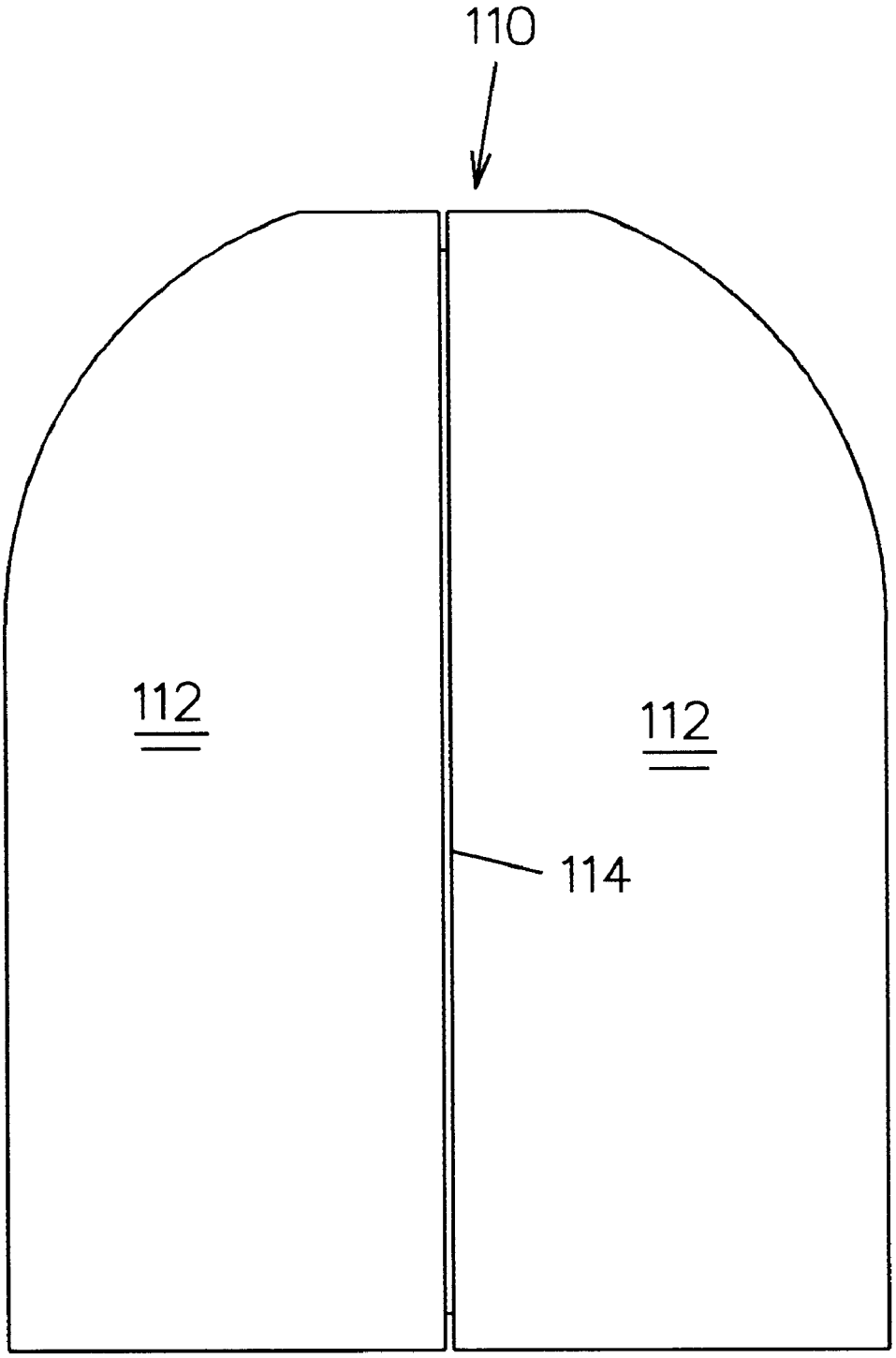
FIG. 4 is a front view of the bouquet holder shown in FIG. 1.
Figure 5:
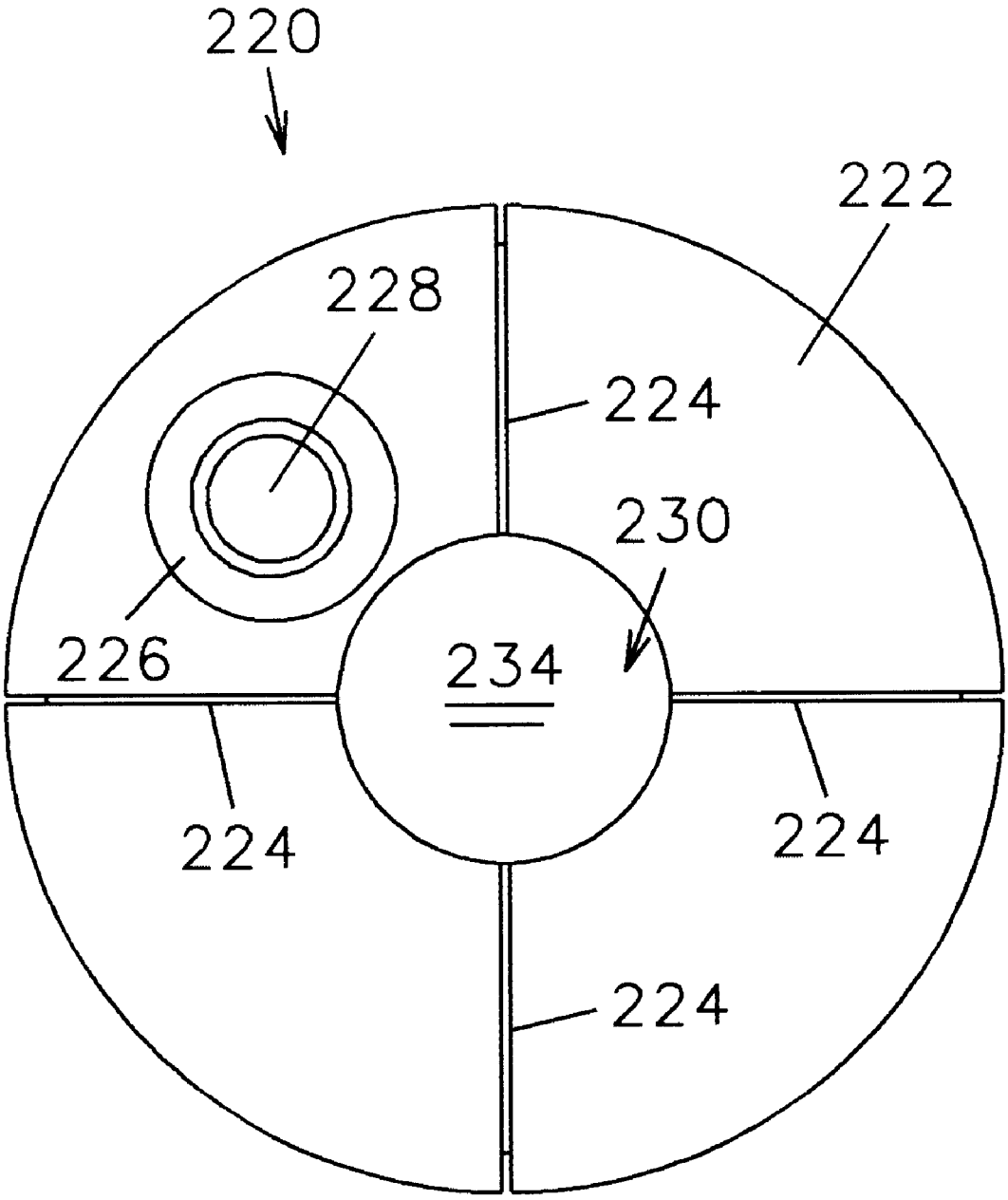
FIG. 5 is a bottom view of the bouquet holder shown in FIG. 2.

An alternative embodiment 200 shown in FIGS. 2 and 5, is very similar to the first embodiment except as discussed below. Balloon holder 200 includes body member 210 made of lightweight transparent material such as plastic or glass. It is understood that the material used in body member 210 is of sufficient thickness to embody slits 214 similar to slits 114 of the first embodiment 100. Holder 200 also includes a base plate 220 (FIG. 5) which has a circular recess 226 formed in the bottom side 222 thereof, the recess 226 presenting an aperture through which ballast may be inserted into the holder 200 to sufficiently anchor the plurality of helium filled balloons engaged with the holder 200. Suitable ballast may include sand or decorative items such as hard candy, marbles, or the like. A rubber plug 228 is insertable into the aperture of the recess 226 to secure the ballast within the body member 210. A hollow cylindrical shaft 230 presents a throughbore or passageway therethrough and includes upper and lower openings 232 and 234. Shaft 230 extends through the center of body member 210 and base plate 220 for receiving balloon tethers through the passageway formed thereby.

As shown in FIG. 2, the lower ends of the tethers 1000 are knotted at 1010 and inserted into shaft 230. Upon the knot 1010 being placed adjacent base 220, the tether ends below the knot are extended along the slits 224, 214 with the free ends of the tethers 1000 extending from the top body member. The tethers are frictionally held within each slit. The balloons with ballast within the transparent body 210 present a pleasing decoration. Again the balloons are releasable from embodiment 200 upon removal of the engaged tether portion from the slits 214, 224.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A balloon holder for a plurality of balloons each balloon having a tether presenting a free end for grasping by a user, said holder comprising:

a body member having an exterior surface and a central throughbore extending from a body upper end to a body lower end;

a plurality of slits extending through said exterior surface of said body, one end of each said slit communicating with said throughbore at said upper end and another end of each said slit communicating with said throughbore at said lower end, each of said slits adapted to engage a portion of a tether of a balloon therein.

2. A balloon holder as claimed in claim 1 wherein said body member is dome-like in configuration.

3. A balloon holder as claimed in claim 1 wherein said ends of said slits extend radially outwardly from said upper and lower ends of said throughbore.

4. A balloon holder as claimed in claim 1 having four said slits.

5. A balloon holder as claimed in claim 1 further comprising:

a base at said lower end of said body, said throughbore and said slits extending from said upper end of said body and through said base.

6. A balloon holder as claimed in claim 5 wherein said base includes:

an aperture in said body member and displaced from said throughbore; and a releasable plug in said aperture for allowing access into said body member.

7. A balloon holder as claimed in claim 6 wherein said body member is hollow, a release of said plug allowing for insertion of ballast in said body member.

8. A balloon holder as claimed in claim 7 wherein said body member is formed of a transparent material, whereby, to view ballast inserted in said holder.

9. A balloon holder for a plurality of balloons each balloon having a tether presenting a free end for grasping by a user, said holder comprising:

a generally cylindrical body member presenting a closed end at a first end thereof;

a base plate at a second end of said body member;

a throughbore extending through said body member between said first and said second ends; and a plurality of slits in said body member, said slits communicating at one slit end with said throughbore at said first end of said body member, said slits extending along said body member and said base for communicating at an opposed slit end with said throughbore at said second end of said body member, said slits adapted to frictionally engage a tether of a balloon therein, whereby to associate a balloon with said holder.

10. A balloon holder as claimed in claim 9 wherein said slits extend radially outwardly from said throughbore at said first and second throughbore ends.

11. A balloon holder as claimed in claim 9 having four said slits.

12. A balloon holder as claimed in claim 9 further comprising:

a bore in said base; and a releasable plug in said bore, a release of said plug allowing for insertion of ballast in said body member.

13. A balloon holder for a plurality of balloons each balloon having a tether presenting a free end for grasping by a user, said holder comprising:

a body member having upper and lower ends;

a base at said lower end of said body member;

a passageway extending between said ends of said body member; and a plurality of slits in said body member having first and second opposed ends, said slits extending along said body member and said base and said base with said opposed ends of said slit communicating with said passageway, said passageway receiving a portion of a tether of a balloon therein for a friction fit engagement of a portion of said tether within a slit for securing a balloon tether to the balloon holder.

14. A balloon holder as claimed in claim 13 wherein said ends of said slits communicate with said passageway at said lower and upper ends of said body member.

15. A balloon holder as claimed in claim 13 having four said slits.

16. A balloon holder as claimed in claim 13 wherein said base member presents a compartment for holding ballast therein.

17. A balloon holder as claimed in claim 16 further comprising a releasable plug in said base for providing access to said compartment for insertion of ballast therethrough.

18. A balloon holder as claimed in claim 16 where said body member is formed of a transparent material to view ballast inserted therein.

19. A balloon holder as claimed in claim 16 wherein said body member is hollow, said passageway presenting a circular sleeve whereby a compartment surrounds said sleeve.

20. A balloon holder as claimed in claim 19 comprising:

means in said body, for providing access to said compartment, said access allowing for insertion of selected ballast in said compartment.

* * * * *